US007794297B1

(12) United States Patent
Katzfey

(10) Patent No.: US 7,794,297 B1
(45) Date of Patent: Sep. 14, 2010

(54) SECTIONALIZED SURFBOARD

(76) Inventor: Lance J. Katzfey, 9024 Meadowrun Pl., San Diego, CA (US) 92129

( * ) Notice: Subject to any disclaimer, the term of this patent is extended or adjusted under 35 U.S.C. 154(b) by 17 days.

(21) Appl. No.: 12/378,223

(22) Filed: Feb. 12, 2009

(51) Int. Cl.
*B63B 35/81* (2006.01)

(52) U.S. Cl. ..... 441/74; 114/352

(58) Field of Classification Search ..... 114/77 R, 114/352; 441/74
See application file for complete search history.

(56) References Cited

U.S. PATENT DOCUMENTS

| | | | | |
|---|---|---|---|---|
| 3,137,873 | A | 6/1964 | Garrolini | |
| 3,287,754 | A | 11/1966 | Price et al. | |
| 3,409,920 | A | 11/1968 | Brownley | |
| 4,807,549 | A | 2/1989 | Rhodes et al. | |
| 5,476,403 | A | 12/1995 | Hsia | |
| 5,711,692 | A | 1/1998 | Pope | |
| 7,029,350 | B2 | 4/2006 | Katzfey | |
| 7,121,909 | B1 * | 10/2006 | Meyerhoffer | 441/74 |
| 7,347,755 | B1 | 3/2008 | Katzfey | |
| 7,390,234 | B2 * | 6/2008 | Peach | 441/74 |

* cited by examiner

*Primary Examiner*—Lars A Olson

(57) ABSTRACT

A sectionalized surfboard, which can be dismantled into sections and rejoined for use. The sections are joined using one or more metal hooks and metal plates with slots in each section on the bottom of the board. On the top of the board there are one or more pairs of top metal plates in each section joined by a vertically installed bolt(s). Inserting the hook(s) into the slot(s) in the bottom metal plate(s) connects the bottom of the board. The top of the board is connected by a bolt passing vertically through a hole in one section's top metal plate and screwed into a threaded hole in the other section's top metal plate. The metal plates extend into the board and are securely bonded to the skin and foam of the boards. The metal plates can also be bonded to any board stringers. In a second version the top is joined using two bolts. Both sections have threaded holes in their top metal plates. A separate third metal plate with two holes is used with the two bolts to join the top of the board. By using different sets of metal plates with a different spacing in the holes, the rocker of the board can be adjusted.

5 Claims, 5 Drawing Sheets

SECTIONALIZED SURFBOARD

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to a method for building a sectionalized, dissassemblable paddleboard, surfboard or sailboard. The invention typically uses two vertically installed bolts to join the board sections 2. Prior Art With the popularity of surfboards and sailboards there is a need to improve the transportability of the boards. Surfboards and sailboards do not fit into most vehicles, so a roof rack is required for transporting. In addition to the difficulty of adequately tying down the board, it is easy for someone to steal the board off the roof rack. In addition, sunlight will fade the colors and ages the plastic of the board. A sectionalized board, that can be disassembled, will solve these problems. By dividing the board in two or more pieces, the board can be stored inside the vehicle and be locked inside. This saves the time required to tie the board to the roof rack as well as the expense of the rack. The board sections can be stored in the trunk of a car. For storage at home, the disassembled board can easily be stored in a closet and can be maneuvered easily through hallways. To make the assembly acceptable to the user, the assembly and disassembly should only take a few seconds. The assembled board should be as strong as a normal one-piece board with only a small additional weight.

The only successfully marketed sectionalized surfboard design is the design described in U.S. Pat. No. 5,711,692 (1998) to Pope. This design uses clamps and a horizontal tube. The tube fits into receivers in the board sections. One disadvantage is that the tube can bend during use. Another disadvantage is the tube receivers are difficult to make and install into the board. This adds to the cost of making the board. If dirt or sand get into the tube receivers the board can be difficult to assemble or disassemble.

U.S. Pat. No. 5,476,403 (1995) to Hsia describes a sectionalized surfboard, which uses a horizontal pin or bolt to join the sections. This design uses a very long bolt and anchor structures with loops. Since under load, the loops and pin are in tension, the deck of the board must be strong enough to handle the compression loads. The main body of a surfboard is typically made of light foam and significant extra structure must be added to support the loops. U.S. Pat. No. 4,807,549 (1989) to Rhodes et al. describes a sectionalized board design using suitable chevron surfaces and a cable clamp. This board would be very difficult to build with a tight fit and also strong enough. The cable clamping would be difficult to get tight enough to prevent bending.

The sectionalized hull described in U.S. Pat. No. 3,137,873 (1964) to Garrolini discloses a system using telescoping shafts and suitable latches. The sleeves for the shafts would be difficult to mount securely in the surfboard and would add significant weight. In the sectionalized hull disclosed in U.S. Pat. No. 3,287,754 (1966) to Price et al., the hull sections are joined by pairs of clamp assemblies mounted on the upper and lower sides of their respective sections. These clamps would be difficult to install and would be very heavy. Another approach is disclosed in U.S. Pat. No. 3,409,920 (1968) to Brownley who uses a mortise-and-tenon socket and clip arrangement for joining the sections. This design would be difficult to make strong enough.

All these designs are expensive and complicated. They are susceptible to flexing if the parts are not made strong enough or wear with use. They are heavy and difficult to install in a standard surfboard.

The sectionalized surfboard described in my U.S. Pat. No. 7,029,350 (2006) to Katzfey describes a single bolt joining system, which is attached to a central stringer installed in the board. This system uses a long bolt through the top and bottom metal plates.

Many of the surfboards made do not have a central stringer and depend on the board skin and sides (rails) of the board to provide strength.

The sectionalized surfboard described in my U.S. Pat. No. 7,347,755 (2008) to Katzfey describes a two bolt joining system. Two assemblies are attached to the board skin and foam near the sides (rails) of the board to provide strength. This system is used for boards without a central stringer.

OBJECTS AND ADVANTAGES

The object of the present invention is to provide a sectional surfboard-like board design, which can be adapted to use as a surfboard, paddleboard, or windsurfer. In one embodiment, there are two joining assemblies, which are typically mounted near the left and right sides of the board. My design uses stainless steel metal plates, which are molded into plastic joining assemblies. These assemblies are glued to the top and bottom skins of the board and also glued to the internal foam. On the bottom one side has a formed flat metal hook, which inserts into a slot in a bottom metal plate of the other side for joining the bottom of the board. At the top of the board a short vertically installed bolt passes through a hole in one metal plate and is tightened into a threaded hole in a second metal plate to join the board. This design makes it very easy to assemble and disassemble the board. A large board, such as a Standup Paddle Board, can be quickly assembled with the board horizontal on the ground. The joining parts can be retrofitted to an existing board or built into a new board. In another embodiment, two bolts are used with the installed top metal plates both having threaded holes. A third metal plate with two holes for the bolts is used to attach the top plates. By using different plates with slightly different spacing between the holes, small changes can be made to the board rocker.

DRAWINGS

Figures

In the drawings, where like reference numbers indicate like parts,

DRAWINGS

Reference Numbers

Figure 1:
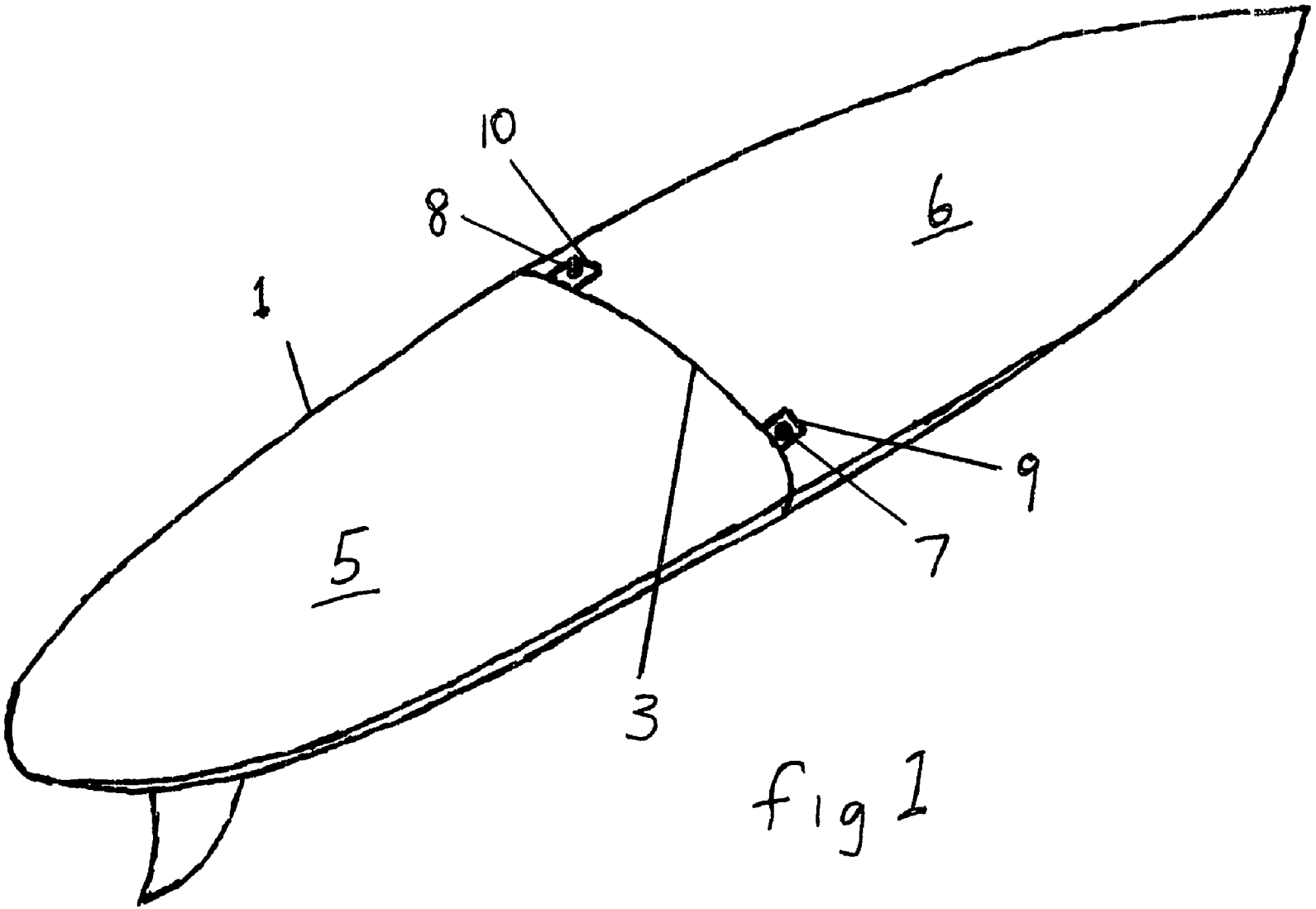
FIG. 1 is a perspective view of a fully assembled two piece sectionalized surfboard in accordance with the present invention.

1 surfboard
3 line showing where board divides
5 back section
6 front section
7 removable joining bolt
8 removable joining bolt
9 recess in board
10 recess in board
20 recess in board for slotted metal plate 44
22 bottom metal hook
24 top metal plate with threaded hole
25 top recess in board for top metal plate 41
26 threaded hole for bolt 40
40 joining bolt
41 top metal plate with hole for bolt
42 hole for inserting bolt 40
44 bottom metal plate with slot
45 slot in bottom metal plate
81 bottom metal plate with slot
82 slot in bottom metal plate
84 recess in board for metal plate 91
85 top metal plate with threaded hole
86 threaded hole
91 metal plate with two holes for bolts
92 hole for bolt
93 hole for bolt

DETAILED DESCRIPTION OF PREFERRED EMBODIMENTS

An embodiment of the present invention will now be described with reference to the drawings. An example of a surfboard divided into two sections will be used to illustrate this embodiment. The invention is not limited to dividing a board into two sections. There can be as many sections as desired. The surfboard described is divided near the middle into two sections. Boards made with a similar construction method such as paddleboards and sailboards could also be sectionalized.

FIG. 1 shows the assembled surfboard 1 in accordance with the present invention. It includes a front section 6, a back section 5, and a joining bolts 7 and 8 (The heads of bolts 7 and 8 are recessed respectively into recesses 9 and 10 so only the heads of bolts 7 and 8 are visible). A dividing line 3 shows where the board sections separate when disassembled. To separate the sections bolts 7 and 8 are removed and the flat hooks are moved down out of the slots.

Figure 2:
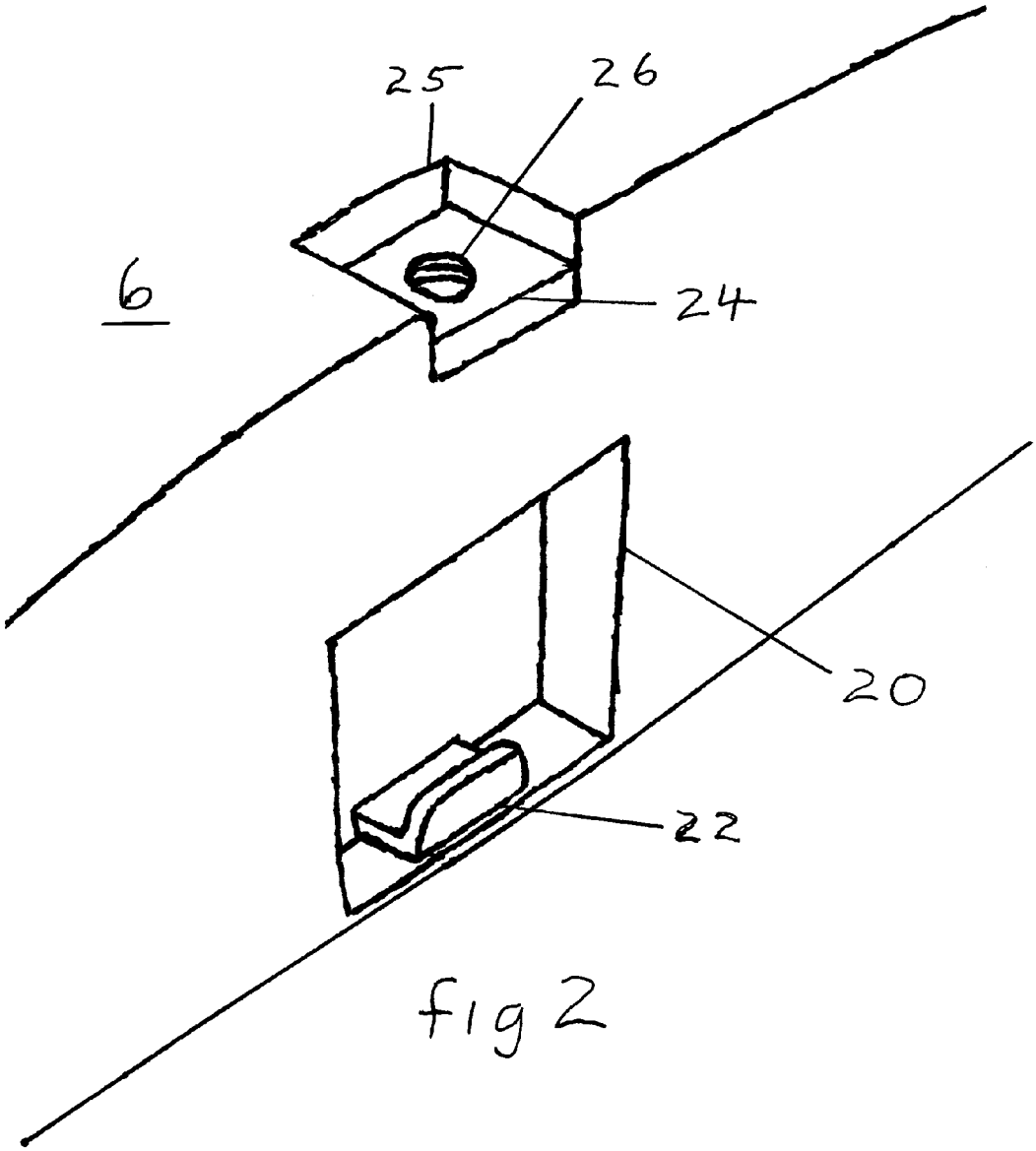
FIG. 2 is a perspective view of one side of the joining assembly

FIG. 2 shows one embodiment of surfboard 1 showing one side of the mating parts in board section 6. FIG. 2 shows the visible part of metal plate 22. Metal plate 22 extends into board section 6 and is securely bonded to the foam and the inside of the bottom skin of the board section 6. Metal plate 22 is bent into a hook for the slot 45 in metal plate 44. There is a cavity 20 in the face of the board so that the protruding part of metal plate 44 with the slot can fit inside when the slot is mated with the end of the hook. FIG. 2 shows the protruding part of metal plate 24. Metal plate 24 extends into board section 6 and is securely bonded to the foam and to the inside of the top skin of board section 6. The top metal plate 24 has a threaded hole 26 for the bolt 40. Metal plate 24 is mounted so that the metal plate 41 fits on top of metal plate 44 and fits in recess 25.

Figure 3:
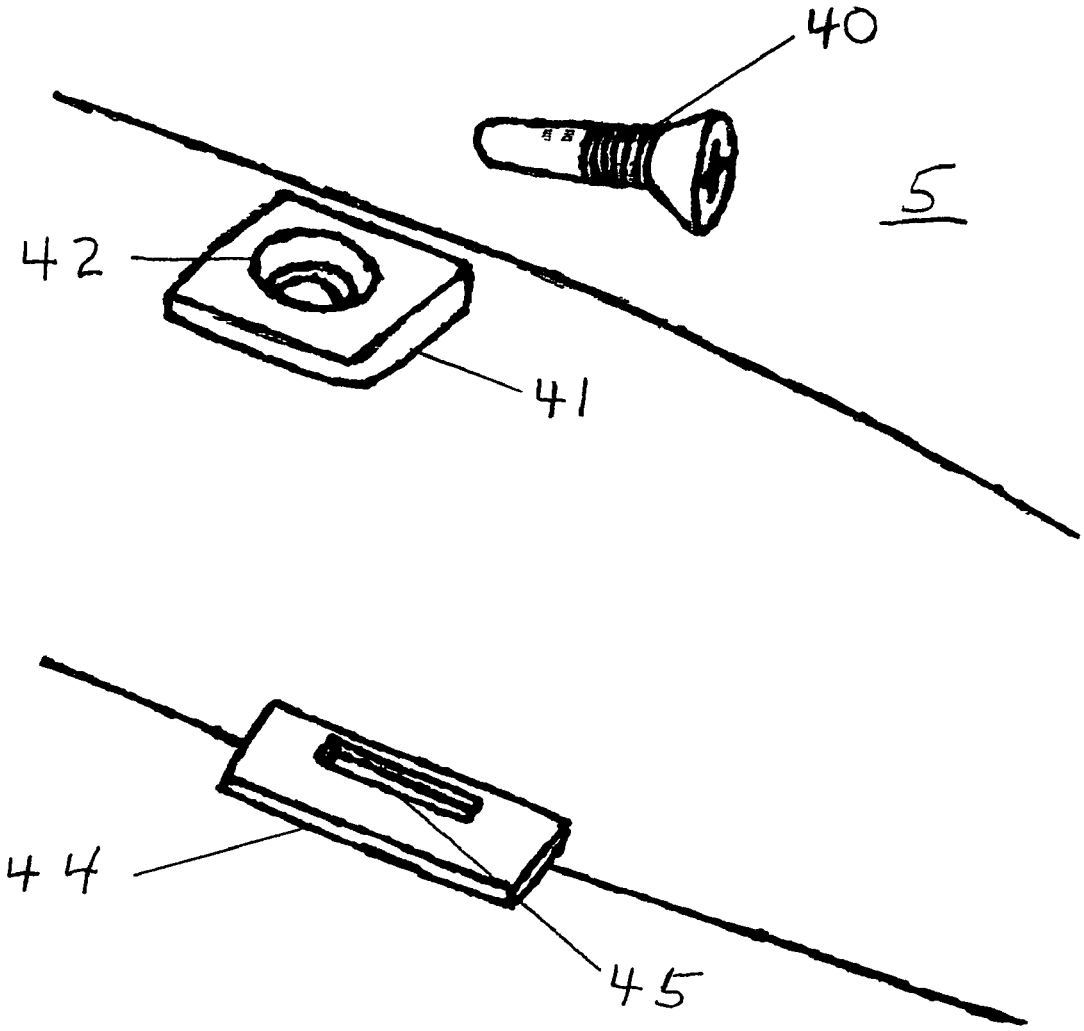
FIG. 3 is a perspective view of the other side of the joining assembly

FIG. 3 shows one embodiment of surfboard 1 showing one side of the mating parts in board section 5. FIG. 3 shows the protruding part of metal plate 44. Metal plate 44 extends into board section 5 and is securely bonded to the foam and to the inside of the bottom skin of board section 5. The metal plate 44 has a slot 45, which fits over the metal hook 22 in cavity 20 on board section 6 when the sections 5 and 6 are joined. FIG. 3 shows the protruding part of metal plate 41. Metal plate 41 extends into board section 5 and is securely bonded to the foam and to the inside of the top skin of board section 5. Metal plate 41 fits into the recess 25 on board section 6. When both sections 5 and 6 are joined, bolt 40 fits through hole 42 and is tightened into treaded hole 26.

Figure 4:
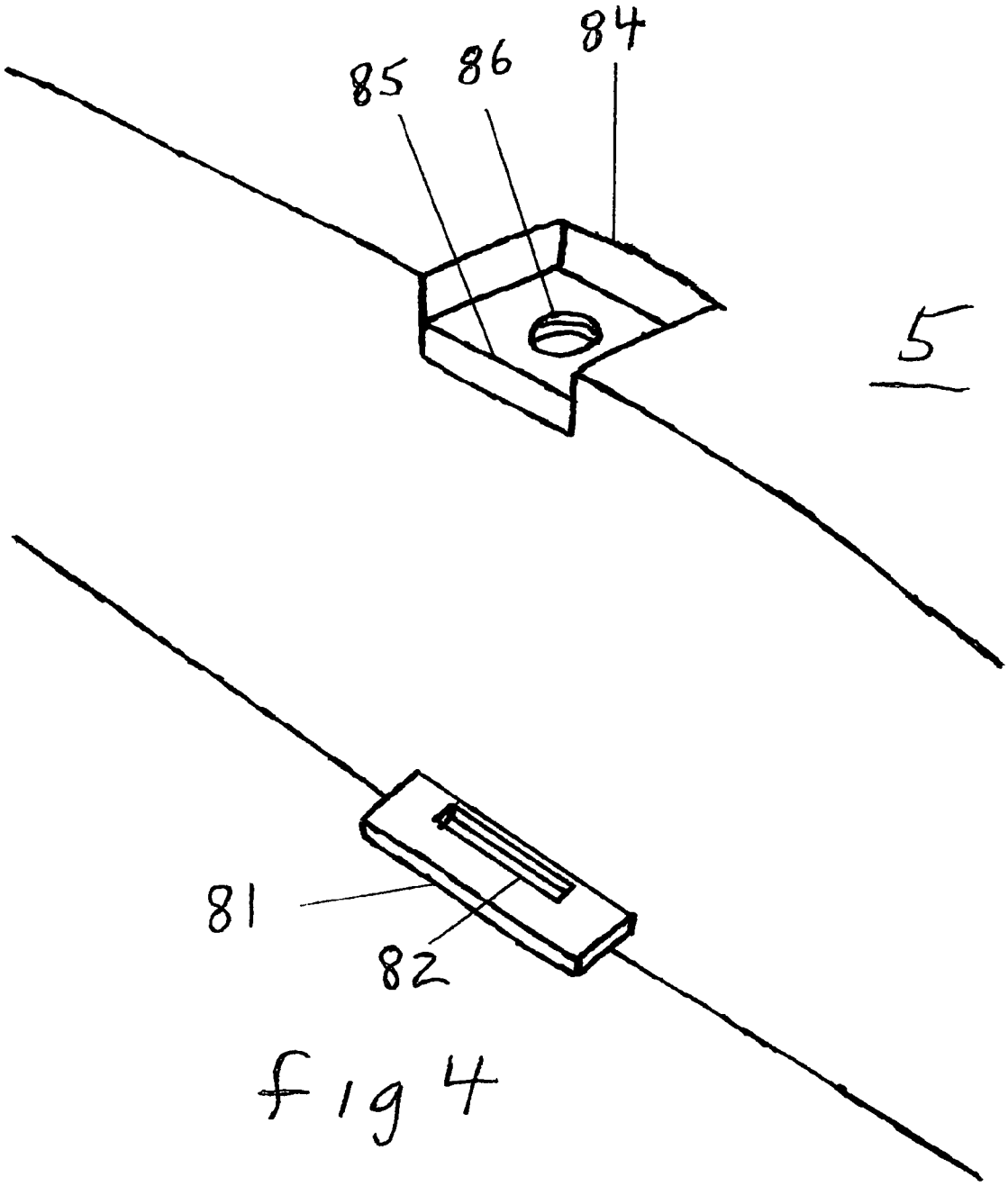
FIG. 4 is a perspective view of an alternate other side of the joining assembly

FIG. 4 shows an alternate top part system for board section 5 to allow for adjustment of board bottom shape or rocker. The top metal plates both of both sections 5 and 6 have threaded holes and 2 bolts are used for joining. A third top metal plate 91 with two holes is used to join the sections. By making different metal plates with a slightly different spacing between the holes, the bottom shape or board rocker can be adjusted. FIG. 4 shows the protruding part of metal plate 81. Metal plate 81 extends into board section 5 and is securely bonded to the foam and to the inside of the top skin of board section 5. The metal plate 81 has slot 82 which mates with hook 22 to connect the bottom of the board. FIG. 4 shows the visible part of metal plate 85. Metal plate 85 extends into board section 5 and is securely bonded to the foam and to the inside of the top skin of board section 5. There is a recess 84 above metal plate 85 for metal plate 91 and a threaded hole 86 for a bolt.

Figure 5:
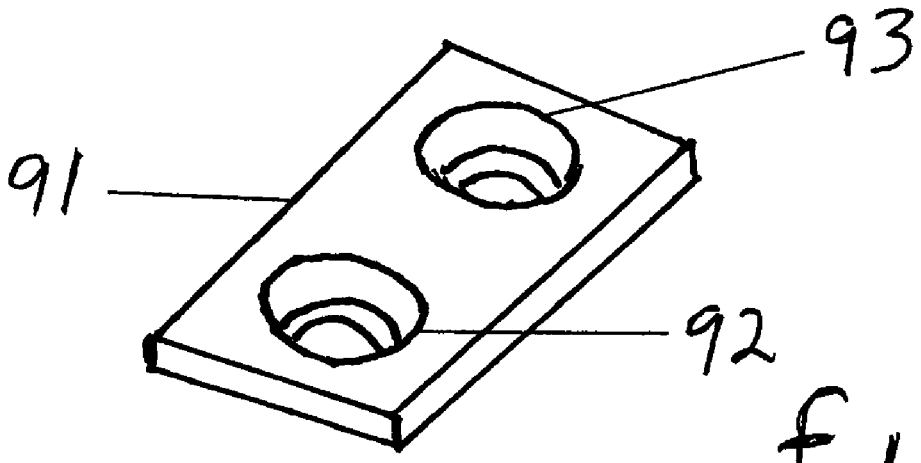
FIG. 5 is a perspective view of the joining metal plate

FIG. 5 shows the top metal plate 91 with holes 92 and 93. This plate is used with the joining parts shown in FIGS. 2 and 4. For joining, hook 22 is inserted in slot 82 joining the bottom. Two bolts are installed through metal plate 91 holes 92 and 93 and tightened into threaded holes 26 and 86 to join the sections. By using different metal plates 91 with a slightly different spacing between holes, the rocker of the board can be adjusted. If the distance between the holes is greater the bottom of the board will be flatter and have less rocker for higher speeds. If desired, the small gap in the board along the top of the board can be filled in with a removable spacer. If the distance between the holes is minimized, the board will have more rocker, for more maneuverability and better low speed performance.

I claim:

1. A sectionalized paddleboard, surfboard or windsurfer board, said board having a foam core and with a plastic skin covering said foam core, said board having a first and second section having at least one top joining means and having at least one bottom joining means; said bottom joining means comprising a first bottom metal plate with a slot, a second bottom metal plate with an end bent up about 90 degrees to form a hook, said end bent up is sized to fit into said slot of said first bottom metal plate, said metal plates are bonded to said plastic skin and said foam of said board first and second sections; said metal plates are mounted so that the bottom of said board is joined by inserting said end bent up of said second bottom metal plate into said slot of said first bottom metal plate.

2. The joining means of claim 1 with said top and bottom joining means are reversed.

3. The joining means of claim 1 where there are more than two sections.

4. The said bottom joining means of claim 1 where said top joining means comprises a first top metal plate, a second top metal plate and a bolt where said first metal plate has a hole for said bolt and said second metal plate has a threaded hole for said bolt, said metal plates are bonded to said plastic skin and said foam of said board first and second sections; where said top metal plates are mounted so said bolt passes through said hole of said first top metal plate and is tightened in said threaded hole of second top metal plate to join the top of said board sections.

5. The joining means of claim 1 where said top joining means comprises a first top metal plate, a second top metal plate, a joining metal plate, and two bolts where said first metal plate and said second metal plate have a threaded hole for said bolts, said first and second metal plates are bonded to said plastic skin and said foam of said board first and second sections; said joining metal plate has two holes for said two bolts, where said first and second top metal plates are mounted so said two bolts are inserted through said two holes of said joining metal plate and are tightened in said threaded holes of said first and second top metal plates to join the top of said board sections; by using multiple joining metal plates with slightly different spacing between said holes, a board bottom shape or a board rocker can be adjusted.

* * * * *